US005701056A

United States Patent [19]

Shinohara

[11] Patent Number: 5,701,056

[45] Date of Patent: Dec. 23, 1997

[54] PARTITION WALL STRUCTURE FOR PLASMA DISPLAY PANEL

[75] Inventor: Takuo Shinohara, Tokyo, Japan

[73] Assignee: NEC Corporation, Japan

[21] Appl. No.: 647,332

[22] Filed: May 9, 1996

[30] Foreign Application Priority Data

May 31, 1995 [JP] Japan ..... 7-133683

[51] Int. Cl.[6] ..... H01J 17/49

[52] U.S. Cl. ..... 313/584; 313/585; 313/586; 313/268; 313/292

[58] Field of Search ..... 313/584, 585, 313/583, 581, 586, 245, 250, 257, 258, 262, 268, 288, 289, 292

[56] References Cited

U.S. PATENT DOCUMENTS 4,518,894 5/1985 Andreadakis ..... 313/584 X
5,264,758 11/1993 Iijima et al. ..... 313/585 X

FOREIGN PATENT DOCUMENTS 63-232238 9/1988 Japan ..... H01J 11/00
2-74749 6/1990 Japan ..... H01J 17/00
0242548 9/1990 Japan ..... H01J 17/00

*Primary Examiner*—Ashok Patel
*Attorney, Agent, or Firm*—Hayes, Soloway, Hennessey, Grossman & Hage, P.C.

[57] ABSTRACT

A plasma display panel is provided which includes (a) a first substrate, (b) a second substrate, (c) a plurality of sets of electrode pairs extending in a direction A, (d) a partition wall structure formed overlapping the sets of electrode pairs, the partition wall structure including first partition walls extending in a direction B perpendicular to the direction A and second partition walls extending in parallel with the direction A, each of the first and second partition walls defining a cell therein, and (e) third partition walls extending in the direction B. The sets of electrode pairs, the partition wall structure and the third partition walls are arranged in this order between the first and second substrates. The first partition walls have a width $W_H$ greater than a width $W_D$ of the third partition walls. Advantageously, this construction of the plasma display panel permits the panel to exhibit improved luminance and contrast characteristics, and permits the display to constitute a high grade display.

12 Claims, 6 Drawing Sheets

PARTITION WALL STRUCTURE FOR PLASMA DISPLAY PANEL

BACKGROUND OF THE INVENTION

1. Field of the Invention

The invention relates to a plasma display panel to be used for a terminal display or a planar cathode ray tube display, and more particularly to partition wall structure for improving both luminance and contrast.

2. Description of the Related Art

A color plasma display panel excites fluorescent material by means of ultraviolet rays generated by discharge in gases to thereby cause the fluorescent material to emit visible light, thereby carrying out operation of the display. Among many types of color plasma display panels, an AC type one is superior in luminance, light emission efficiency and lifetime to others.

A conventional reflection and AC surface discharge type plasma display panel is illustrated in FIGS. 1 to 3, wherein FIG. 1 is a perspective view, FIG. 2 is a plan view as viewed from a front substrate 1, and FIG. 3 is a cross-sectional view taken along the line D—D in FIG. 2. The illustrated conventional plasma display panel has a transparent front substrate 1 and a rear substrate 10 disposed facing each other. On a lower surface of the front substrate 1 is formed a plurality of transparent electrodes 2 (see FIG. 2), and on each of the transparent electrodes 2 is formed a bus electrode 11 in parallel with the transparent electrodes 2. As illustrated in FIG. 3, the transparent electrodes 2 and the bus electrodes 11 are covered with a thick transparent insulating layer 3 which is further covered with a protection layer 4. The transparent insulating layer 3 is made of lead glass having a low fusing point. The protection layer 4 is constituted of either a thin film made of MgO deposited by evaporation or sputtering or a thick film formed by printing or spraying.

On the protection layer 4 is formed a grid-shaped light absorbing partition wall structure 5. The light absorbing partition wall structure 5 is formed by thick-film printing, and is made of thick film paste containing black pigment for enhancing contrast. As illustrated in FIG. 2, the light absorbing partition wall structure includes first partition walls 5*a* and second partition walls 5*b*. The first partition walls 5*a* extend in a direction perpendicular to the transparent and bus electrodes 2 and 11, whereas the second partition walls 5*b* extend in a direction parallel to the transparent and bus electrodes 2 and 11. Each of areas surrounded by the first and second partition walls 5*a* and 5*b* defines a discharge cell 30.

The transparent electrodes 2 are disposed in parallel with each other and spaced away from each other by a predetermined distance, for instance about 100 μm. The transparent electrodes 2 are arranged on the front substrate 1 so that every two transparent electrodes 2 and hence every two bus electrodes 11 are passing over each of the cells 30 defined by the first and second partition walls 5*a* and 5*b*. There is carried out electric discharge between adjacent transparent electrodes 2.

The reason for providing the bus electrodes 11 is as follows. In general an, AC voltage pulse ranging from tens of kHz to hundreds of kHz is applied across the adjacent transparent electrodes 2 to thereby produce electric discharge. However, a film made of tin oxide or ITO of which the transparent electrodes 2 are made has high sheet resistance, and thus electrical resistance per a transparent electrode is raised up to tens of kΩ. The raised electrical resistance degrades the build-up characteristics of an applied pulse voltage, and accordingly it becomes difficult to control the plasma display panel by display signals. Hence, on the transparent electrodes 2 are formed the bus electrodes 11 made of a thick metal film to thereby lower resistance of the transparent electrodes 2 for readily driving the plasma display panel.

As illustrated in FIG. 1, on an upper surface of the rear substrate 10 is formed a plurality of data electrodes 8 made of a thick or thin metal film for storing display data therein. The rear substrate 10 together with the data electrodes 8 is covered With a white-color insulating layer 7 composed of a thick paste containing lead glass having a low fusing point and white pigment such as $TiO_2$ therein. The data electrodes 8 are equally spaced away from each other and extend in a direction perpendicular to the direction in which the transparent electrodes 2 extend.

On the white-color insulating layer 7 is formed a plurality of third partition walls 6. The third partition wails 6 are spaced away from each other by a distance equal to a spacing between the adjacent first partition walls 5*a*, and extend in a direction perpendicular to the direction in which the transparent electrodes 2 extend. The third partition walls 6 are formed by thick-film printing and are designed to reflect light therefrom.

To a space formed between the third partition walls 6 is applied fluorescent material 9 emitting light having a color corresponding to each of the discharge cells 30. The fluorescent material 9 is applied also to sidewalls of the third partition walls 6 in order to increase area to which fluorescent material is applied.

As illustrated in FIG. 3, the first partition walls 5*a* formed on the front substrate 1 and the third partition walls 6 formed on the rear substrate 10 are adhesively connected to each other in hermetically sealed condition to thereby define a plurality of chambers 12 in which discharge in gas is to occur. Into each of the chambers 12 is introduced dischargeable gas such as a gas mixture of He, Ne and Xe at 500 Torr.

An AC voltage having a pulse-shaped waveform is applied across the adjacent transparent electrodes 2 to thereby cause discharge in gas or surface discharge to occur. As a result, there is generated plasma in the chambers 12 accompanied with radiation of ultraviolet rays. The thus generated ultraviolet rays excite the fluorescent material 9 to cause the fluorescent material 9 to emit visible light. Thus, there occurs light emission for display through the transparent front substrate 1.

Each of the transparent electrodes 2 causing surface discharge includes a scanning electrode and a support electrode. In actual panel driving, a support pulse is applied to the transparent electrodes or surface discharge electrodes 2. When electric discharge in gases is to be produced, there is applied a voltage across the scanning electrodes and the data electrodes 8 to thereby produce opposed electric discharge. The thus produced opposed electric discharge is kept alive between the adjacent surface discharge electrodes 2 by virtue of the above mentioned support pulse.

In order to enhance luminance and contrast of a plasma display panel, Japanese Unexamined Patent Publication No. 2-242548 suggests a plasma display panel having the two-layered partition walls as illustrated in FIG. 4. The suggested plasma display panel has a front panel 15 and a rear panel 19 facing to each other. The rear panel 19 is covered with a cathode layer 18. On a lower surface of the front panel 15 are formed an anode 13 and a pair of fluorescent materials 14 between which the anode 13 is sandwiched. The front and rear panels 15 and 19 are connected to each other via layers 16 and 17. The layers 16 disposed in contact with the front panel 15 art designed to absorb light therein, and the layers 17 disposed closer to the rear panel 19 are designed to reflect light therefrom.

This plasma display panel is characterized in that each of the partition walls defining a plurality of cells for display arranged in a matrix has a two-layered structure including a light absorbing layer 16 through which a viewer catches emitted light, and a light reflecting layer 17. Though the light absorbing layer 16 and the light reflecting layer 17 are illustrated in FIG. 4 as having slight taper or slightly varying width, they have almost the same width in actual fact. In other words, the light absorbing layer 16 and the light reflecting layer 17 do not have different width sufficient to cause a step therebetween.

The suggested plasma display panel is actually capable of improving contrast by virtue of the light reflecting layer 17. However, a partition wall designed to be narrow for enhancing luminance and an increased area of the front panel 15 to which the fluorescent material 14 is applied cause the contrast to degrade due to white color which is body color of the fluorescent material 14. On the other hand, a partition wall designed to be wide for enhancing contrast decreases area to which the fluorescent material 14 is applied, thereby resulting in luminance degraded. Namely, enhancement of luminance and enhancement of contrast are in reciprocal relation.

Japanese Unexamined Utility Model Publication No. 2-74749 has suggested another plasma display panel as illustrated in FIG. 5. This plasma display panel includes a front panel 15 and a rear panel 19 facing each other. The front panel 15 has a cathode electrode 21 formed thereon, whereas the rear panel 19 has an anode electrode 22 formed thereover. The front and, rear panels 15 and 19 are connected to each other through partition walls 20 each of which is constituted of a black wall 20*b* for absorbing light therein and a white wall 20*a* for reflecting light therefrom. A space surrounded by the front and rear panels 15 and 19 and the partition wall 20 defines electric discharge chamber 23.

This plasma display panel is characterized in that the black wall 20*b* has a different width from that of the white wall 20*a*. However, in this prior art, since the black wall 20*b* has a smaller width than the white wall 20*a*, a viewer who catches light emission through the front panel 15 would recognize that the black wall 20*b* has the same width as the white wall 20*a*. Thus, this prior art is able to provide only the same degree of contrast as the contrast obtained when the black wall 20*b* has the same width as the white wall 20*a*.

Japanese Unexamined Patent Publication. No. 63-232238 has suggested still another plasma display panel as illustrated in FIG. 6. This plasma display panel includes a substrate 31, a cover substrate 32, a pair of display electrodes 30*a* and 30*b* formed on the substrate 31, a dielectric layer 33 covering the substrate 31, a selection electrode 34 formed on the dielectric layer 33, a separator 35, transparent partition layers 36 formed on the cover substrate 32, opaque partition layers 37 formed on the transparent partition layers 36, and fluorescent material 38 applied between the adjacent transparent and opaque partition walls 36 and 37.

In the above mentioned prior plasma display panels, if partition walls are designed to be narrower in width to thereby increase area to which fluorescent material is applied for enhancing luminance, there occurs reduction in contrast due to white color of the fluorescent material. To the contrary, if partition walls are designed to be wider in width for enhancing contrast, area to which fluorescent material is applied is decreased, resulting in luminance reduction. Namely, the enhancement of luminance and the enhancement of contrast are in reciprocal relation. The prior art cannot provide a plasma display panel which is capable of enhancing both luminance and contrast in practical use.

SUMMARY OF THE INVENTION

It is an object of the present invention to provide a plasma display panel capable of providing both enhanced luminance and contrast.

The present invention provides a plasma display panel including (a) a first substrate, (b) a second substrate, (c) a plurality of electrode pairs extending in a direction A, (d) a partition wall structure formed overlapping the electrode pairs, the partition wall structure including first partition walls extending in a direction B perpendicular to the direction A and second partition walls extending in parallel with the direction A, each of the first and second partition walls defining a cell therein, and (e) third partition walls extending in the direction B. The electrode pairs, the partition wall structure and the third partition walls are arranged in this order between the first and second substrates, and the first partition walls are designed to have a width $W_H$ greater than a width $W_D$ of the third partition walls.

The present invention further provides a plasma display panel including (a) a first substrate, (b) a second substrate, (c) a plurality of electrode pairs extending in a direction A, (d) first partition walls formed overlapping the electrode pairs, the first partition walls extending in a direction B perpendicular to the direction A, and (e) second partition walls extending in the direction B, the electrode pairs, the first partition walls and the second partition walls being arranged in this order between the first and second substrates, and the first partition walls having a width $W_H$ greater than a width $W_D$ of the second partition walls.

For instance, the width $W_H$ and $W_D$ are defined in accordance with the following equation:

$$0.75 \leq (a-W_H)/(a-W_D) < 1.0$$

wherein "a" represents a pitch between adjacent cells in the direction A.

The second partition walls may have a width $W_V$ defined in accordance with the following equation:

$$0.6 \leq 1-(W_V/b) < 1.0$$

wherein "b" represents a pitch between adjacent cells in the direction B.

It is preferable that the first and second partition walls are designed to absorb light, and the third partition walls are designed to reflect light.

The electrode pairs and the partition wall structure may be formed in this order on one of the first and second substrates, and the third partition walls on the other. As an alternative, the electrode pairs, the partition wall structure and the third partition walls are formed on only the first or second substrate.

Though the plasma display panel made in accordance with the present invention has a smaller numerical aperture than that of a conventional plasma display panel due to an increased width of the light absorbing partition walls, the plasma display panel is able to prevent reduction of luminance and enhance contrast by designing the light reflecting partition walls to have a width equal to or smaller than a width of partition walls of a conventional plasma display panel. Thus, the present invention provides a high grade and balanced display.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

A preferred embodiment in accordance with the present invention will be explained hereinbelow with reference to drawings.

Figure 1:
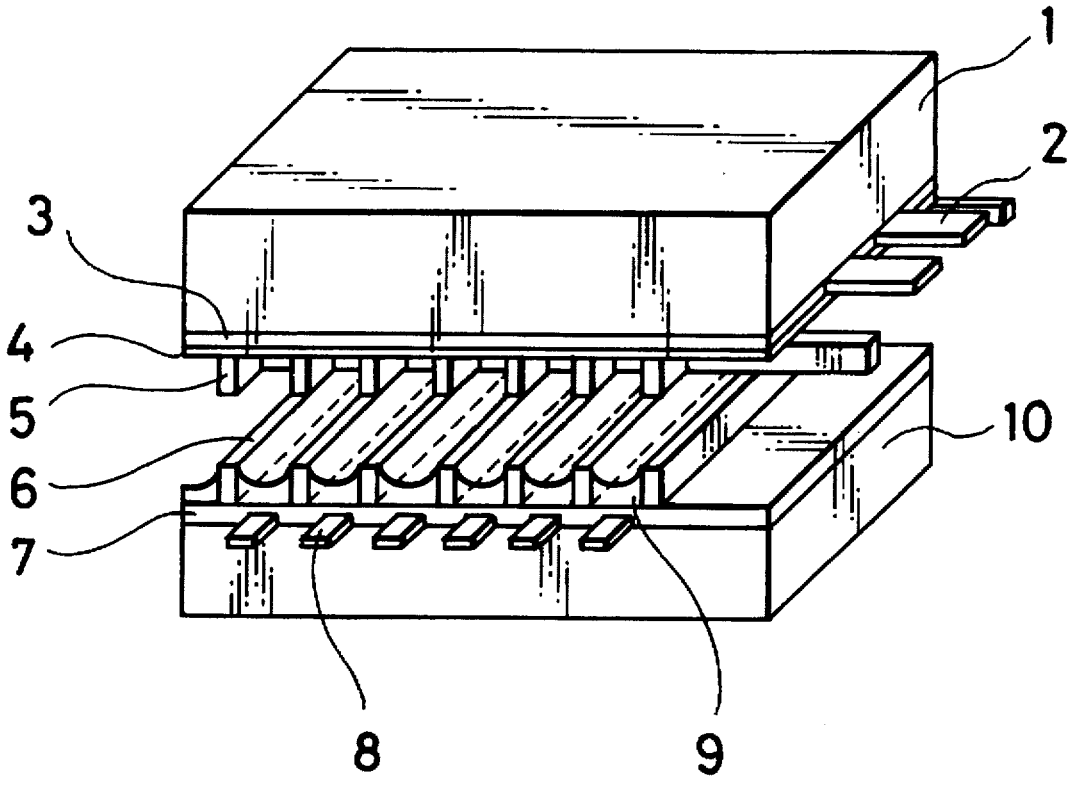
FIG. 1 PRIOR ART
FIG. 1 is a perspective view illustrating a conventional plasma display panel.
Figure 2:
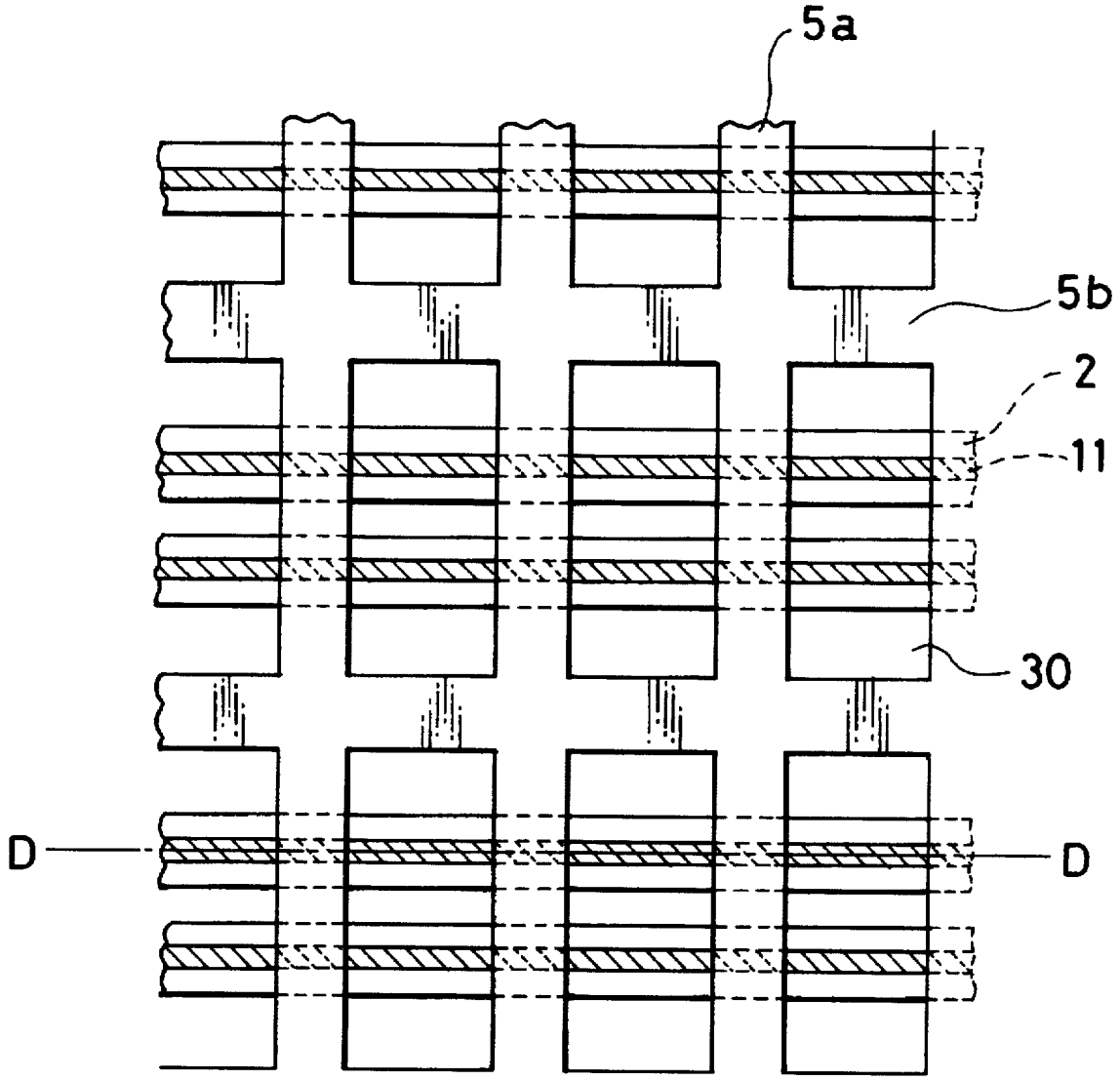
FIG. 2 PRIOR ART
FIG. 2 is a plan view of the conventional plasma display panel illustrated in FIG. 1.
Figure 3:
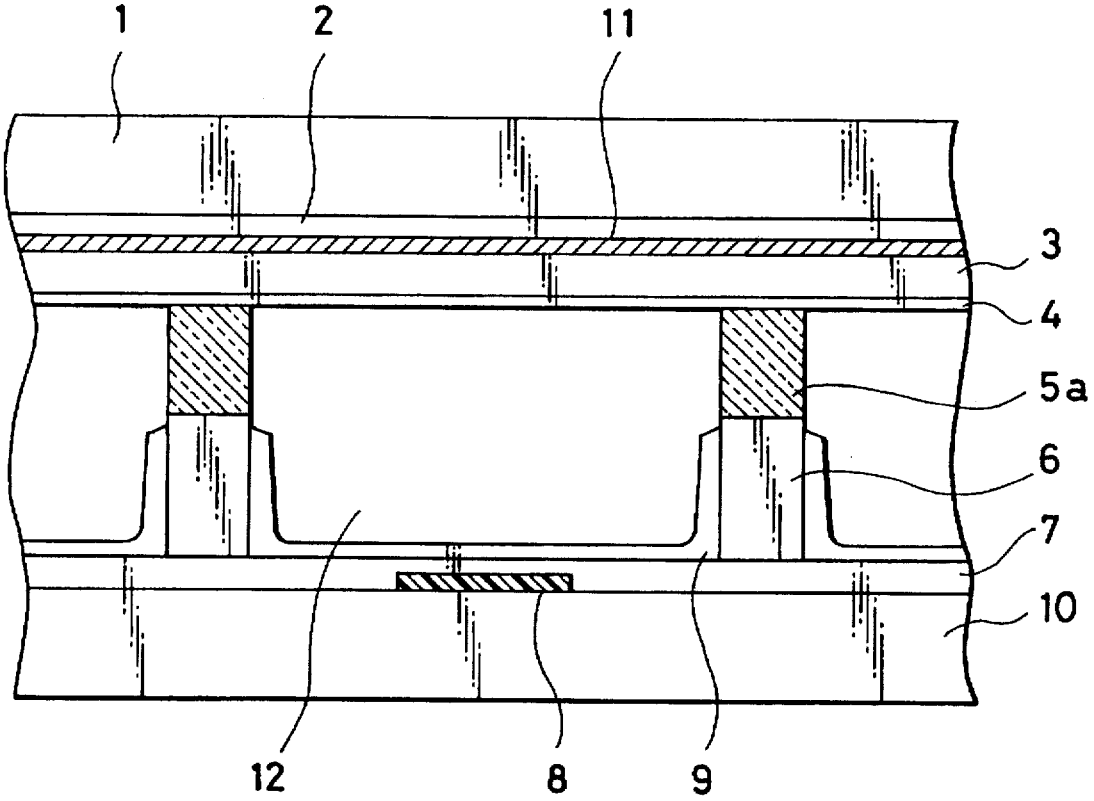
FIG. 3 PRIOR ART
FIG. 3 is a cross-sectional view taken along the line D—D in FIG. 2.
Figure 4:
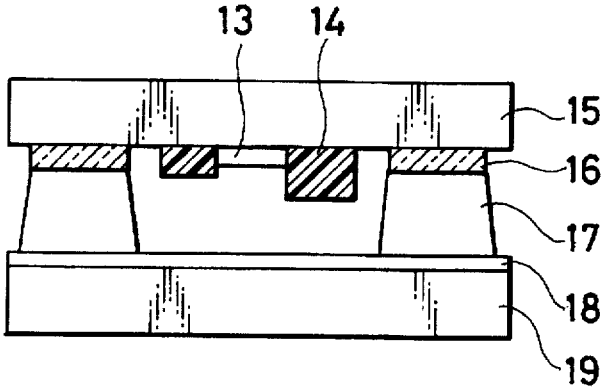
FIG. 4 PRIOR ART
FIG. 4 is a cross-sectional view of another conventional plasma display panel.
Figure 5:
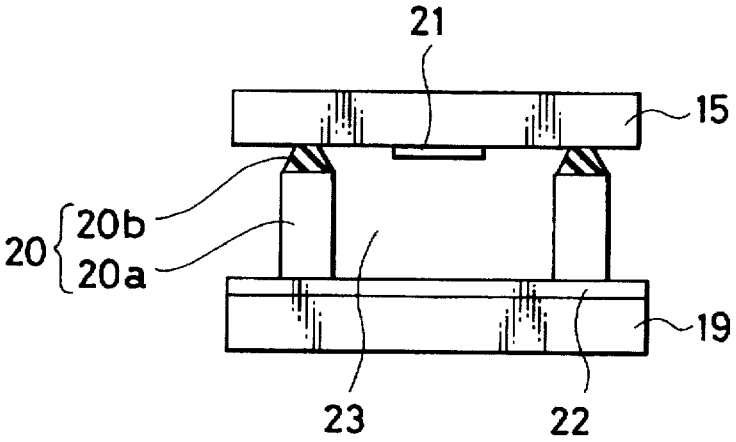
FIG. 5 PRIOR ART
FIG. 5 is a cross-sectional view of still another conventional plasma display panel.
Figure 6:
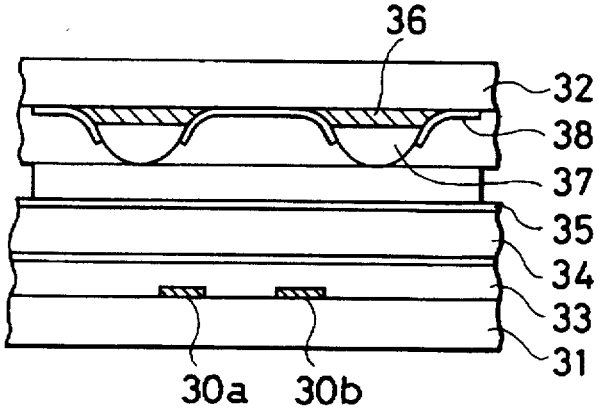
FIG. 6 PRIOR ART
FIG. 6 is a cross-sectional view of still another conventional plasma display panel.
Figure 7:
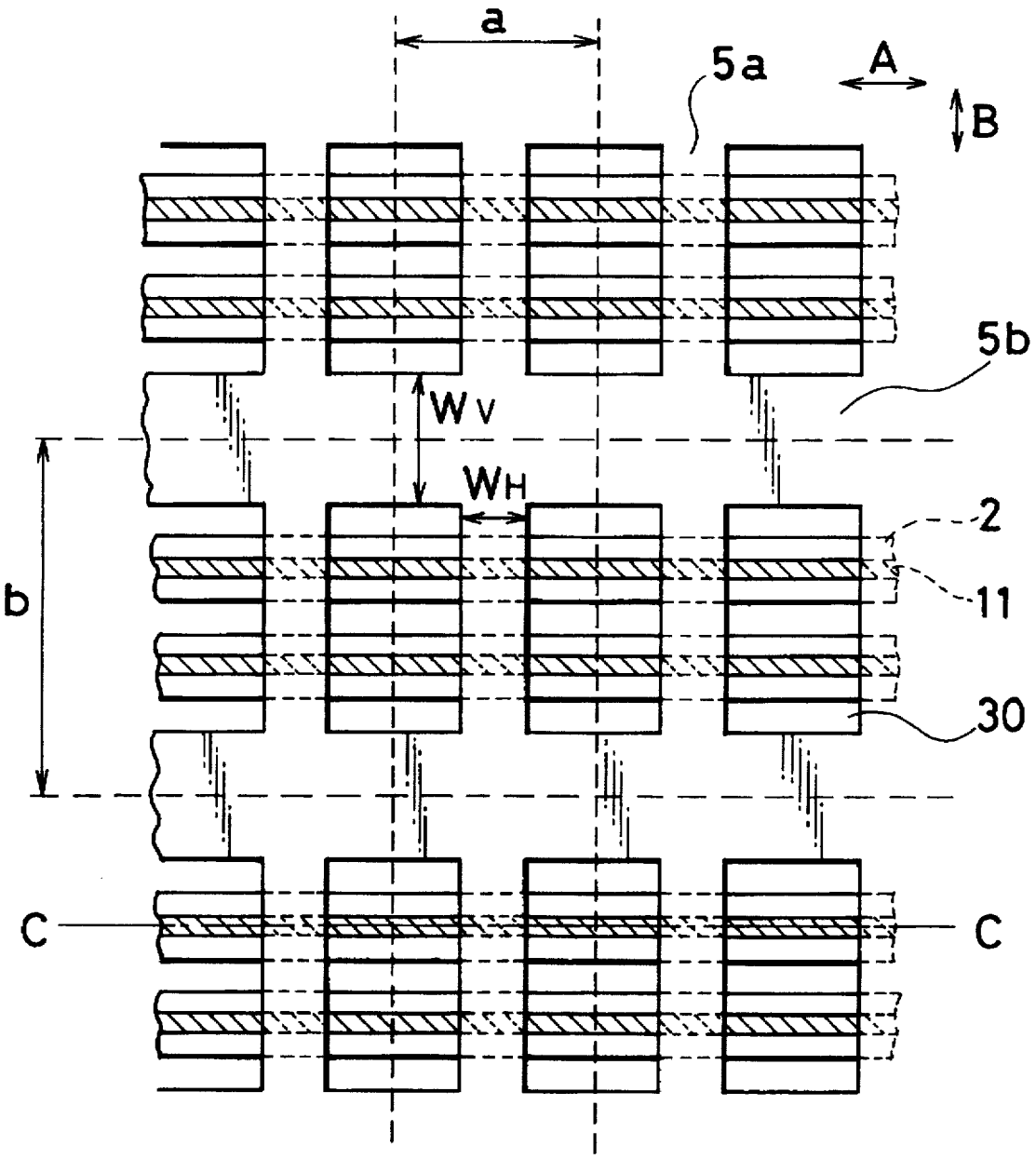
FIG. 7 is a plan view illustrating a plasma display panel made in accordance with the embodiment of the present invention.
Figure 8:
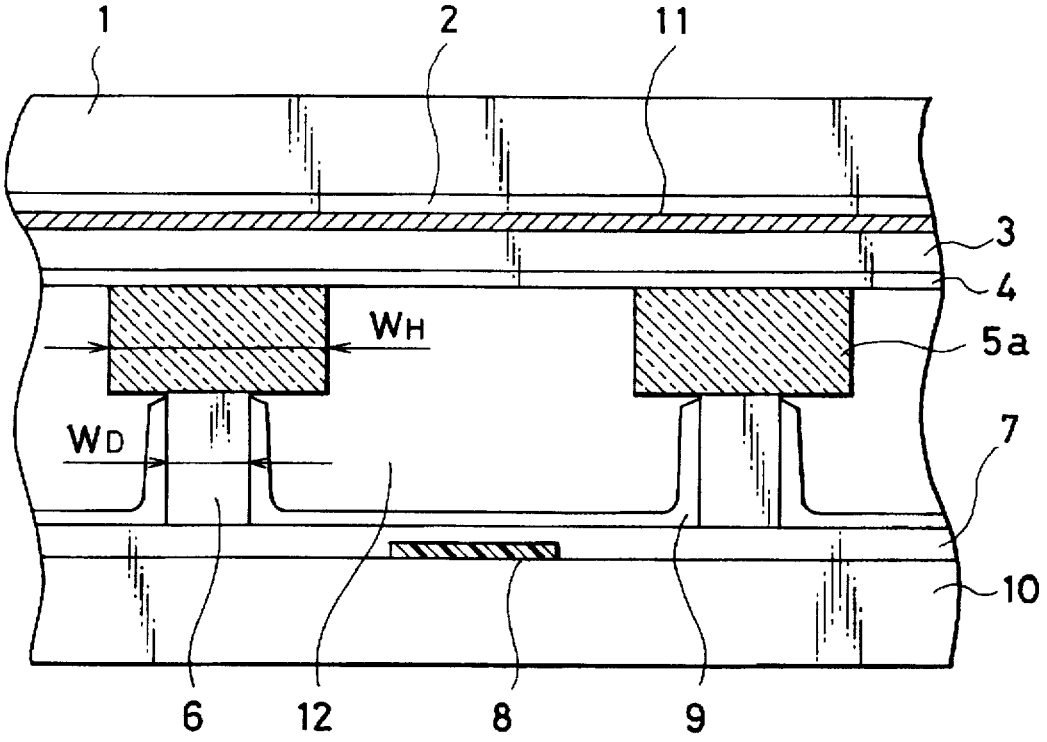
FIG. 8 is a cross-sectional view taken along the line C—C in FIG. 7.

Referring to FIGS. 7 and 8, a plasma display panel of the embodiment has a transparent front substrate 1 and a rear substrate 10 disposed facing each other. On a lower surface of the front substrate 1 is formed a plurality of transparent electrodes 2, and on each of the transparent electrodes 2 is formed a bus electrode 11 in parallel With the transparent electrodes 2, as illustrated in FIG. 7. The transparent electrodes 2 and the bus electrodes 11 are covered with a thick transparent insulating layer 3 which is further covered with a protection layer 4. The transparent insulating layer 3 is made of lead glass having a low fusing point, and the protection layer 4 is made of MgO.

On the protection layer 4 is formed a grid-shaped partition wall structure 5 which is designed to absorb light therein. The light absorbing partition wall structure 5 is made of thick film paste containing black pigment for enhancing contrast. As illustrated in FIG. 7, the light absorbing partition wall structure 5 includes first partition walls 5*a* extending in a direction (hereinafter, referred to as "direction B") perpendicular to the transparent and bus electrodes 2 and 11 and having a width $W_H$, and second partition walls 5*b* extending in a direction (hereinafter, referred to as "direction A") parallel to the transparent and bus electrodes 2 and 11 and having a width $W_V$. Each of areas surrounded by the first and second partition walls 5*a* and 5*b* defines a discharge cell 30.

The transparent electrodes 2 are disposed in parallel with each other and spaced away from each other by about 100 μm. The transparent electrodes 2 are arranged on the front substrate 1 so that every two transparent electrodes 2 and hence every two bus electrodes 11 are passing over each of the cells 30. Between the adjacent transparent electrodes 2 is carried out electric discharge.

On an upper surface of the rear substrate 10 is formed a plurality of data electrodes 8 (only one of them is illustrated in FIG. 8) made of a thin metal film for storing display data therein. The rear substrate 10 together with the data electrodes 8 is covered with a white-color insulating layer 7 composed of a thick paste containing lead glass having a low fusing point and $TiO_2$ as white pigment. The data electrodes 8 are equally spaced away from each other and extend in the direction B.

On the white-color insulating layer 7 is formed a plurality of third partition walls 6 having a width $W_D$. The third partition walls 6 are spaced away from each other by a distance equal to a spacing between the adjacent first partition walls 5*a*, and extend in the direction B. The third partition walls 6 are formed by thick-film printing and are designed to reflect light therefrom.

To a space formed between the third partition walls 6 is applied fluorescent material 9 which emits light having a color corresponding to each of the discharge cells 30. The fluorescent material 9 is applied also to sidewalls of the third partition walls 6.

The first partition walls 5*a* formed on the front substrate 1 and the third partition walls 6 formed on the rear substrate 10 are adhesively connected to each other in hermetically sealed condition to thereby define a plurality of chambers 12 in which discharge in gas is to occur. Into each of the chambers 12 is introduced dischargeable gas such as a mixture of He, Ne and Xe gases at 500 Torr.

An AC voltage pulse is applied across the adjacent transparent electrodes 2 to thereby cause discharge in gas or surface discharge to occur. As a result, there is generated plasma in the chambers 12 accompanied with radiation of ultraviolet rays. The thus generated ultraviolet rays excite the fluorescent material 9 to cause the fluorescent material 9 to emit visible light. Thus, a viewer can observe light emission through the transparent front substrate 1.

Referring now to FIG. 8, the present embodiment is characterized in that the first partition walls 5*a* are designed to have width $W_H$ greater than width $W_D$ of the third partition walls 6. The greater width $W_H$ of the first partition walls 5*a* reduces numerical aperture of the cells 30 when viewed through the front substrate 1 through which light is transmitted to a viewer. However, since area to which the fluorescent material 9 is applied remains unreduced, it is possible to decrease reduction in luminance caused by reduction in numerical aperture of the cells 30, and significantly enhance contrast. In addition, it is possible to prevent reduction in luminance by designing the width $W_D$ to be smaller than a conventional plasma display panel to thereby increase area to which the fluorescent material 9 is applied.

Figure 9:
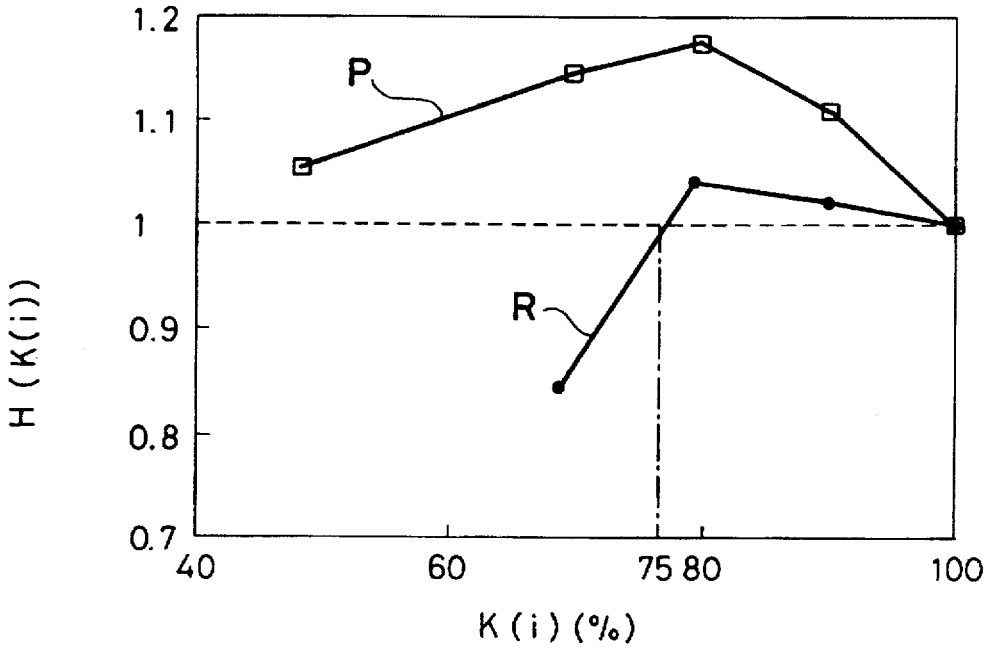
FIG. 9 is a graph showing the relationship between a numerical aperture of a cell and reduction in luminance.

FIG. 9 shows data about the plasma display panel. The abscissa in FIG. 9 represents a numerical aperture ratio when the width $W_V$ and $W_H$ are varied on the assumption that a numerical aperture ratio K(0) obtained when the width $W_V$ of the second partition walls 5*b* is equal to zero and the first partition walls 5*a* have the width $W_H$ equal to the width $W_D$ of the third partition walls 6 ($W_H$=$W_D$), and denoted by the following equation (A). Specifically, provided that the first partition walls 5*a* have a width $W_H$ (i) and the second partition walls 5*b* have a width $W_V$ (i) in a certain arrangement, the numerical aperture ratio K (i) is represented with the equation (B) when only the width $W_V$ (i) is varied or with the equation (C) when only the width $W_H$ (i) is varied. In the following equations, "a" represents a pitch between the adjacent cells 30 in the direction A, and "b" represents a pitch between adjacent cells 30 in the direction B.

$$K(0)=(a-W_D)\times b \quad (A)$$

$$K(i)=[(a-W_D)(b-W_V(i))/(a-W_D)b]\times 100\ [\%]=[1-W_V(i)/b]\times 100\ [\%] \quad (W_H=W_D) \quad (B)$$

$$K(i)=[(a-W_H(i))b/(a-W_D)b]\times 100\ [\%]=(a-W_H(i))/(a-W_D)\times 100\ [\%] \quad (W_V=0 \text{ and } W_H \geqq W_D) \quad (C)$$

The ordinate represents a ratio of a rate of change in luminance to numerical aperture. Supposing that luminance is represented with L(0) when numerical aperture is 100% and luminance is represented with L(K(i)) when numerical aperture is K(i), the ratio H(K(i)) of rate of change in luminance to numerical aperture is represented by the following equation (D).

$$H(K(i))=[L(K(i))/L(0)]/K(i) \quad (D)$$

A curve indicated with "P" in FIG. 9 shows the relationship between K(i) anti H(K(i)) obtained when only the width $W_V$ of the second partition walls 5b is varied. Values of the abscissa are calculated with the equation (B), and values of the ordinate are calculated with the equation (D). A curve indicated with "R" in FIG. 9 shows the relationship between K(i) and H(K(i)) obtained when only the width $W_H$ of the first partition walls 5a is varied. Values of the abscissa are calculated with the equation (C), and values of the ordinate are calculated with the equation (D).

In FIG. 9, when value of the ordinate is equal to 1.0, the reduction in numerical aperture is in accord with reduction in luminance. When value of the ordinate is greater than 1.0, reduction in luminance is smaller than reduction in numerical aperture. That is, there is expected enhancement of contrast in greater degree than reduction in luminance. To the contrary, when value of the ordinate is smaller than 1.0, reduction in luminance is greater than reduction in numerical aperture. That is, both luminance and contrast are reduced. Accordingly, it is necessary to select numerical aperture so that value of the ordinate is greater than 1.0. Thus, it is necessary to set numerical aperture to be greater than about 0.75 in the curve indicated with "R".

However, it is impossible to remarkably improve contrast relative to conventional plasma display panel when numerical aperture is about 100%. Value of the ordinate in the curve indicated with "P" is greater than 1.0 even when numerical aperture represented in the abscissa is smaller than 50%. However, if numerical aperture is smaller than 60%, luminance is reduced in too much, which is not practical. Thus, the widths $W_V$ and $W_H$ of the second and first partition walls 5b and 5a for providing most suitable numerical aperture are defined in accordance with the following equations (E) and (F).

$$0.6 \leqq 1-(W_V/6)<1.0 \quad (E)$$

$$0.75 \leqq (a-W_H)/(a-W_D)<1.0 \quad (F)$$

It is possible to apply the present invention to a plasma display panel having any cell pitch. Hereinbelow, the widths $W_H$, $W_V$ and $W_D$ of the first, second and third partition walls 5a, 5b and 6 determined in accordance with the present invention for a variety of cell pitches are shown in Table 1.

TABLE 1

| | | | $W_V$ | | $W_H$ | |
|---|---|---|---|---|---|---|
| a | b | $W_D$ | Max. | Min. | Max. | Min. |
| 0.2 | 0.6 | 0.04 | 0.03 | 0.24 | 0.048 | 0.08 |
| 0.2 | 0.6 | 0.06 | 0.03 | 0.24 | 0.067 | 0.095 |
| 0.22 | 0.66 | 0.04 | 0.033 | 0.264 | 0.049 | 0.085 |
| 0.22 | 0.66 | 0.06 | 0.033 | 0.264 | 0.068 | 0.10 |
| 0.3 | 0.9 | 0.05 | 0.045 | 0.36 | 0.063 | 0.113 |
| 0.3 | 0.9 | 0.07 | 0.045 | 0.36 | 0.082 | 0.128 |
| 0.35 | 1.05 | 0.07 | 0.053 | 0.42 | 0.084 | 0.14 |
| 0.35 | 1.05 | 0.10 | 0.053 | 0.42 | 0.113 | 0.163 |
| 0.4 | 1.2 | 0.07 | 0.06 | 0.48 | 0.087 | 0.153 |
| 0.4 | 1.2 | 0.10 | 0.06 | 0.48 | 0.115 | 0.175 |

Unit: mm

In the above mentioned embodiment, the light absorbing partition wall structure including the first and second wall partition walls 5a and 5b is separately formed from the light reflecting partition walls 6 on the front and rear substrates 1 and 10, respectively. However, it should be noted that both the light absorbing partition wall structure 5 and the light reflecting partition walls 6 may be only on the front substrate 1 or the rear substrate 10.

In the above mentioned embodiment, the partition wall structure 5 is designed to include the first and second partition walls 5a and 5b which cooperate with each other to form a grid-shape. However, it also should be noted that the partition wall structure 5 may be designed to include only the first partition walls 5a in a stripe-shaped fashion. Such an arrangement provides the same advantageous effects as the above mentioned embodiment.

Hereinbelow will be described an experimental example. There was fabricated a plasma display panel wherein "a" was 0.4 mm, "b" was 1.2 mm, $W_D$ is 0.1 mm, $W_V$ was 0.24 mm and $W_H$ was 0.16 min. The light absorbing partition wall structure 5 was made of paste containing glass powder and black pigment such as iron oxide, chrome oxide and manganese oxide, and thus the partition wall structure 5 was black in color. The light reflecting partition walls 6 were made of paste containing glass powder and white pigment such as $Al_2O_3$, $TiO_2$, and MgO, and thus the partition walls 6 were white in color. The black-colored partition wall structure 5 including the first and second partition walls 5a and 5b were formed to be 40 μm high, whereas the white-colored partition walls 6 were formed to be 120 μm high. The black-colored partition walls were formed on the front substrate 1, and the white-colored partition walls were formed on the rear substrate 10. The fluorescent material 9 was applied to a surface of the rear substrate 10 and also to a surface of sidewalls of the white-colored partition walls 6.

Then, the front and rear substrates 1 and 10 were secured to each other with mixture of He, Ne and Xe gases being introduced into the chambers 12 at 500 Torr. The thus fabricated plasma display panel was actually lit. In comparison with a plasma display panel in which $W_V=0$ and $W_H=W_D$, the luminance was reduced by about 20%, but black matrix was increased by more than twice.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A plasma display panel comprising:

a first substrate;

a second substrate;

a plurality of sets of electrode pairs, said sets of electrode pairs being for discharging between said first and second substrates, each of said sets of electrode pairs being formed on one of said first and second substrates and extending in a direction A;

a partition wall structure formed overlapping said sets of electrode pairs, said partition wall structure including first partition walls extending in a direction B perpendicular to said direction A and second partition walls extending in parallel with said direction A, each of said first and second partition walls defining a cell therein; and third partition walls extending in said direction B, said first partition walls having a width $W_H$ greater than a width $W_D$ of said third partition walls, said widths $W_H$ and $W_D$ being measured in said direction A, said third partition walls being sandwiched between said partition wall structure and the other of said first and second substrates so that said third partition walls are fully covered in widthwise direction by said first partition walls.

2. The plasma display panel as set forth in claim 1, wherein said width $W_H$ and $W_D$ are defined in accordance with the following equation:

$$0.75 \leqq (a-W_H)/(a-W_D) < 1.0$$

wherein "a" represents a pitch between adjacent cells in said direction A.

3. The plasma display panel as set forth in claim 1, wherein said second partition walls have a width $W_V$ defined in accordance with the following equation:

$$0.6 \leqq 1-(W_V/b) < 1.0$$

wherein "b" represents a pitch between adjacent cells in said direction B.

4. The plasma display panel as set forth in claim 1, wherein said first and second partition walls are light-absorbing, and said third partition walls are light-reflecting.

5. The plasma display panel as set forth in claim 1, wherein said sets of electrode pairs and said partition wall structure are formed on said one of said first and second substrates in this order, said third partition walls are formed on the other of said first and second substrates and said partition wall structure is connected to said third partition walls.

6. The plasma display panel as set forth in claim 1, wherein said sets of electrode pairs, said partition wall structure and said third partition walls are formed on one of said first and second substrates in this order, and said third partition walls are connected to the other of said first and second substrates.

7. A plasma display panel comprising:

a first substrate;

a second substrate;

a plurality of sets of electrode pairs, said sets of electrode pairs being for discharging between said first and second substrates, each of said sets of electrode pairs being formed on one of said first and second substrates and extending in a direction A;

first partition walls formed overlapping said sets of electrode pairs, said first partition walls extending in a direction B perpendicular to said direction A; and said first partition walls having a width $W_H$ greater than a width $W_D$ of said second partition walls, said widths $W_H$ and $W_D$ being measured in said direction A, said second partition walls being sandwiched between said first partition walls and the other of said first and second substrates so that said second partition walls are fully covered in widthwise direction by said first partition walls.

8. The plasma display panel as set forth in claim 7, wherein said width $W_H$ and $W_D$ are defined in accordance with the following equation:

$$0.75 \leqq (a-W_H)/(a-W_D) < 1.0$$

wherein "a" represents a pitch between adjacent first partition walls.

9. The plasma display panel as set forth in claim 7, wherein said first partition walls are light-absorbing, and said second partition walls are light-reflecting.

10. The plasma display panel as set forth in claim 7, wherein said sets of electrode pairs and said first partition walls are formed on said one of said first and second substrates in this order, said second partition walls are formed on the other of said first and second substrates, and said first partition walls are connected to said second partition walls.

11. The plasma display panel as set forth in claim 7, wherein said sets of electrode pairs, said first partition walls and said second partition walls are formed on said one of said first and second substrates in this order, and said second partition walls are connected to the other of said first and second substrates.

12. A plasma display panel comprising:

a first substrate;

a second substrate;

a plurality of sets of electrode pairs for discharging between said first and second substrates, each of said sets of electrode pairs being formed on the first substrate and extending in a direction A;

light-absorbing partition walls formed overlapping said electrode pairs, said light-absorbing partition walls extending in a direction B perpendicular to said direction A; and light-reflecting partition walls extending in said direction B, said light-absorbing partition walls having a width $W_H$ greater than a width $W_D$ of said light-reflecting partition walls, said widths $W_H$ and $W_D$ being measured in said direction A, said light-reflecting partition walls being sandwiched between said light-absorbing partition walls and said second substrate so that said light-reflecting partition walls are fully covered in widthwise direction by said light-absorbing partition walls.

* * * * *

UNITED STATES PATENT AND TRADEMARK OFFICE

CERTIFICATE OF CORRECTION

PATENT NO. : 5,701,056

DATED : December 23, 1997

INVENTOR(S) : Takuo Shinohara

It is certified that error appears in the above-identified patent and that said Letters Patent is hereby corrected as shown below:

Claim 7, Col. 10, line 6, after "A; and" insert --second partition walls extending in said direction B,--.

Signed and Sealed this

Eighteenth Day of August, 1998

Bruce Lehman

*Attest:*

BRUCE LEHMAN

*Attesting Officer*

*Commissioner of Patents and Trademarks*